US011730279B2

(12) United States Patent
Ambuske

(10) Patent No.: US 11,730,279 B2
(45) Date of Patent: Aug. 22, 2023

(54) PORTABLE MATTRESS WITH DROP-STITCH INFLATABLE CHAMBER

(71) Applicant: Aaron Alan Ambuske, Seattle, WA (US)

(72) Inventor: Aaron Alan Ambuske, Seattle, WA (US)

(73) Assignee: HEST CORPORATION, Seattle, WA (US)

( * ) Notice: Subject to any disclaimer, the term of this patent is extended or adjusted under 35 U.S.C. 154(b) by 439 days.

(21) Appl. No.: 16/742,551

(22) Filed: Jan. 14, 2020

(65) Prior Publication Data

US 2020/0221884 A1 Jul. 16, 2020

Related U.S. Application Data

(60) Provisional application No. 62/792,805, filed on Jan. 15, 2019.

(51) Int. Cl.

| | |
|---|---|
| ***A47C 27/08*** | (2006.01) |
| ***A47C 27/18*** | (2006.01) |
| ***A47C 27/00*** | (2006.01) |
| ***A47C 27/15*** | (2006.01) |
| ***A47C 27/14*** | (2006.01) |

(52) U.S. Cl.

CPC ..... *A47C 27/18* (2013.01); *A47C 27/002* (2013.01); *A47C 27/081* (2013.01); *A47C 27/087* (2013.01); *A47C 27/148* (2013.01); *A47C 27/15* (2013.01)

(58) Field of Classification Search

CPC ..... A47C 27/087; A47C 27/08; A47C 27/088; A47C 27/18; A47C 27/082; A47C 27/081; A47C 27/15

See application file for complete search history.

(56) References Cited

U.S. PATENT DOCUMENTS

| | | | | |
|---|---|---|---|---|
| 3,736,604 A * | 6/1973 | Carson, Jr. | A47C 31/001 | 5/678 |
| 5,086,530 A * | 2/1992 | Blake | A47G 9/0246 | 5/500 |
| 5,285,541 A * | 2/1994 | Steed | A47C 27/085 | 5/678 |
| 5,507,048 A * | 4/1996 | Hauser | A47C 27/10 | 5/685 |
| 5,530,978 A * | 7/1996 | Johenning | A47C 27/085 | 5/669 |

(Continued)

*Primary Examiner* — Robert G Santos
*Assistant Examiner* — Ifeolu A Adeboyejo
(74) *Attorney, Agent, or Firm* — Lowe Graham Jones PLLC

(57) ABSTRACT

A mattress includes a foam layer positioned over a platform including a bladder having top and bottom surface joined by threads such that upon inflation the platform stiffens due to strain locking. The foam layer may include an upper layer and a lower layer that is firmer than the upper layer. The foam layer may include a polyurethane foam, such as memory foam. Zipper portions on the edges of the platform may secure to zipper portions on edges of the foam layer. Feet removably mount to a lower surface of the platform, which may include protrusions or straps for securing to the feet. The platform layer may be deflated and rolled with the foam layer for transport and storage.

20 Claims, 15 Drawing Sheets

(56) References Cited

U.S. PATENT DOCUMENTS

| | | | | |
|---|---|---|---|---|
| 5,564,141 | A * | 10/1996 | Anderson | A47C 27/085 5/678 |
| 9,756,951 | B1 * | 9/2017 | Stewart, Jr. | A47C 23/005 |
| 10,582,779 | B2 * | 3/2020 | Roma | A61G 7/05715 |
| 2003/0009830 | A1 * | 1/2003 | Giori | A47C 27/088 5/709 |
| 2004/0049856 | A1 * | 3/2004 | Chae | A47C 27/087 5/709 |
| 2006/0075569 | A1 * | 4/2006 | Giori | A47C 27/084 5/709 |
| 2007/0283501 | A1 * | 12/2007 | Mossbeck | A47C 27/00 5/690 |
| 2008/0000029 | A1 * | 1/2008 | Feingold | A47C 27/087 5/690 |
| 2010/0320818 | A1 * | 12/2010 | Li | A47C 7/021 297/452.41 |
| 2011/0000018 | A1 * | 1/2011 | Kirchhoff | A47C 27/148 219/490 |
| 2012/0060286 | A1 * | 3/2012 | Gendron | A47C 27/007 5/500 |
| 2014/0137332 | A1 * | 5/2014 | McGuire | A47C 27/081 5/713 |
| 2016/0157625 | A1 * | 6/2016 | Schneider | A47C 27/006 5/699 |
| 2016/0262552 | A1 * | 9/2016 | Scarleski | A47C 21/028 |
| 2017/0156508 | A1 * | 6/2017 | Segal | A47C 27/001 |
| 2020/0205579 | A1 * | 7/2020 | Wen | F16K 15/20 |

* cited by examiner

PORTABLE MATTRESS WITH DROP-STITCH INFLATABLE CHAMBER

PRIORITY CLAIM

This application claims the benefit of U.S. Provisional Application Ser. No. 62/792,805 filed Jan. 15, 2019 and entitled PORTABLE MATTRESS WITH DROP-STITCH INFLATABLE CHAMBER.

FIELD OF THE INVENTION

This application relates to portable inflatable mattresses for indoor or outdoor use.

BACKGROUND OF THE INVENTION

A typical mattress for use in the home is highly optimized to ensure the comfort of the user. Such mattresses are also typically very heavy and bulky and are not intended to be portable. In contrast, sleeping options for outdoor use or for temporary indoor use are typically very inadequate. Cots formed of stretched fabric, air mattresses, fold-out beds hidden in couches, or foam pads provide sleeping surfaces that do not nearly approach the comfort of a non-portable mattress.

It would be an advancement in the art to provide an improved portable mattress.

SUMMARY OF THE INVENTION

In one aspect of the invention, a cushion includes a platform formed by a bladder having a top surface and a bottom surface separated by a distance of at least three inches when the bladder is inflated above 6 pounds per square inch (psi), and a valve, the bladder being airtight when the valve is closed. The platform includes an array of threads each extending from the top surface to the bottom surface, the array of threads being distributed over an extent of the top surface and the bottom surface and being sufficient in number that the bladder and the array of threads, when inflated, are stiffer than the bladder alone without the array of threads when inflated.

The cushion may further include a foam pad positioned over the top surface of the platform. The foam pad may include a polyurethane foam, such as memory foam.

The cushion may be embodied as a mattress and may have plurality of feet mounted to the bottom surface, such as at least six feet. The platform may include a plurality of disks adhered to the bottom surface, each foot of the plurality of feet defining a recess sized to receive a disk of the plurality of disks.

In some embodiments, a first zipper portion is secured to the top surface of the bladder and a second zipper portion is secured to the foam pad, the first zipper portion being selectively securable to the second zipper portion.

A corresponding method of use is also disclosed and claimed.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
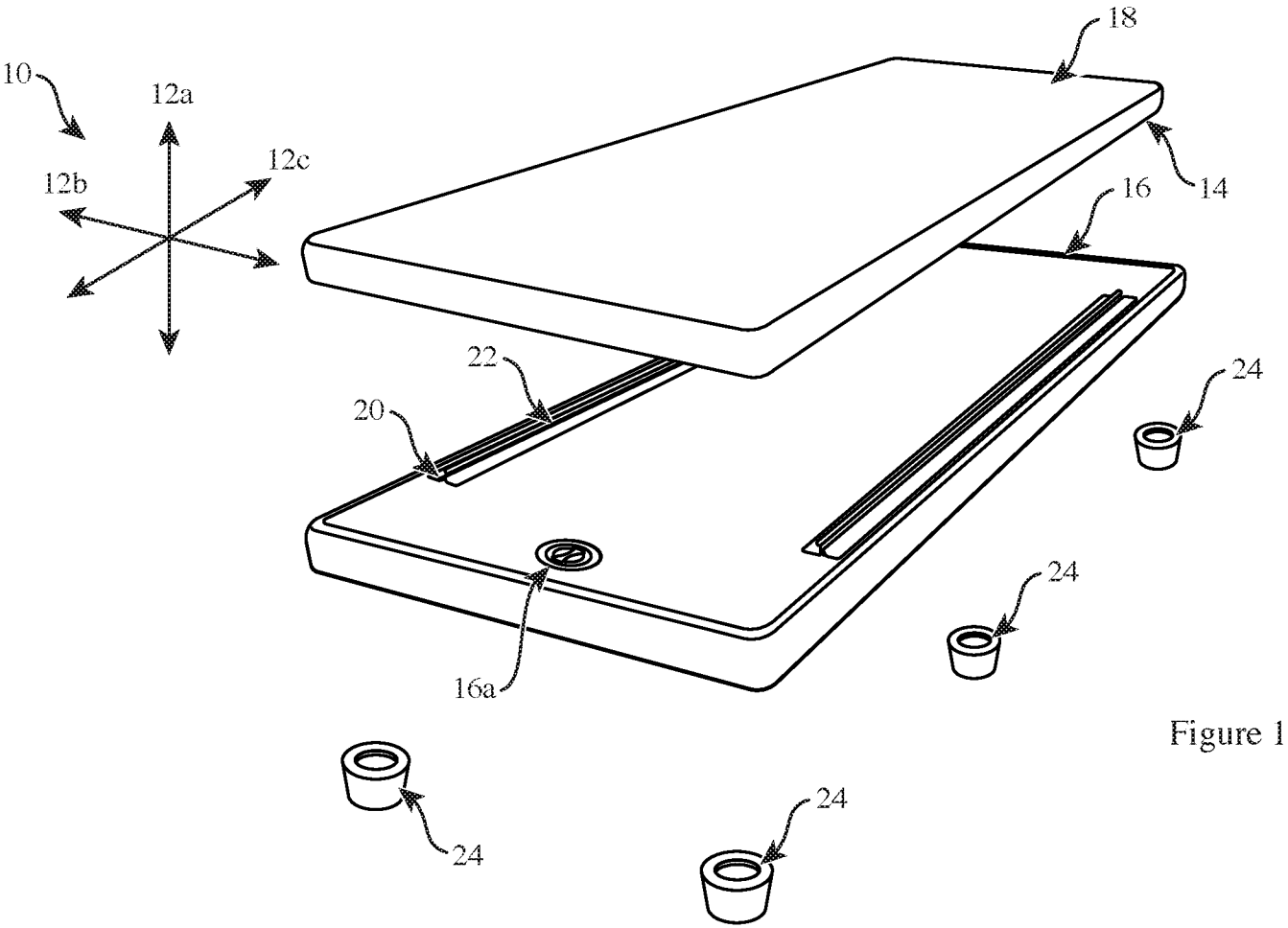
FIG. 1 is a perspective view of a disassembled mattress in accordance with an embodiment of the present invention.
Figure 2:
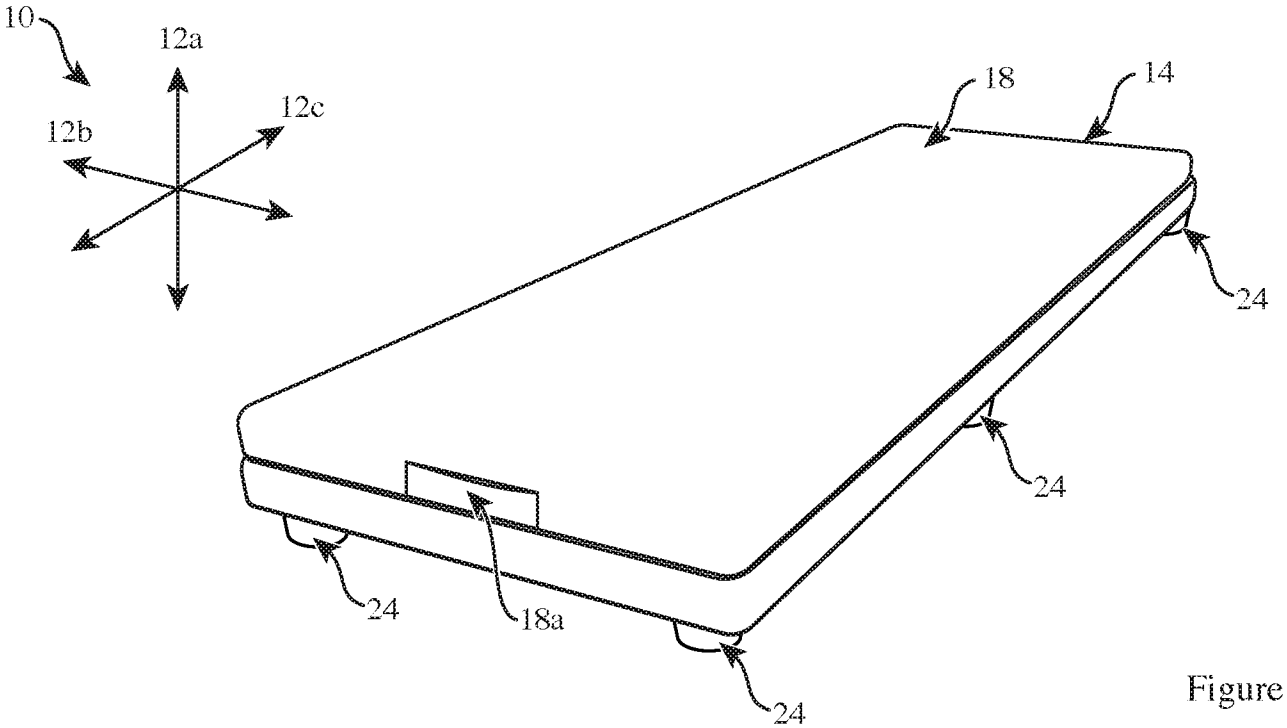
FIG. 2 is a perspective view of an assembled mattress in accordance with an embodiment of the present invention.
Figure 3:
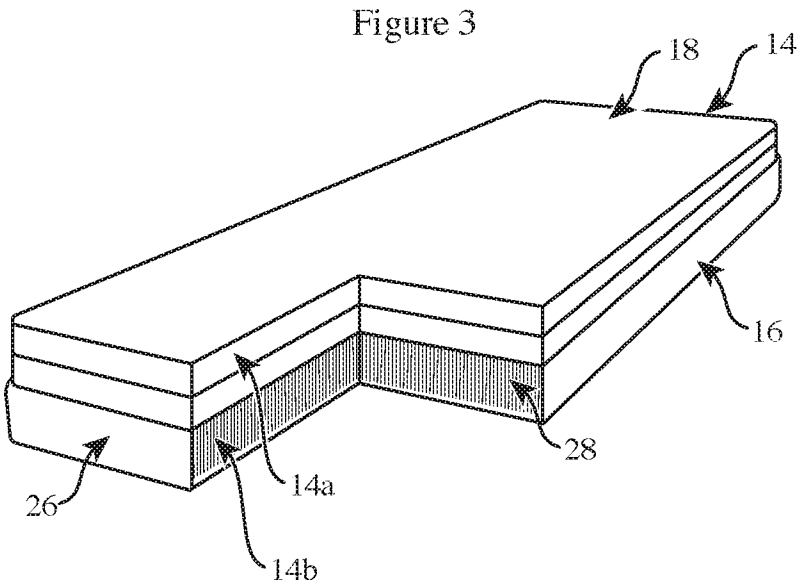
FIG. 3 is a partial cutaway view of a mattress in accordance with an embodiment of the present invention.
Figure 4A:
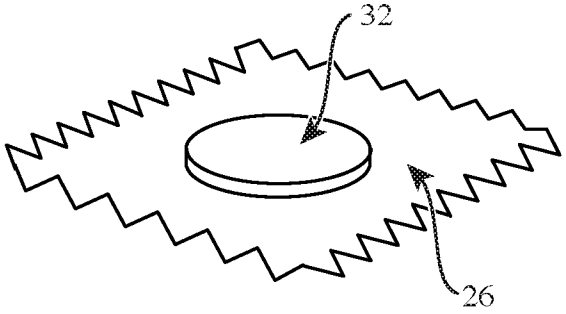
FIGS. 4A and 4B illustrate a structure for mounting feet to a platform of a mattress in accordance with an embodiment of the present invention.
Figure 4B:
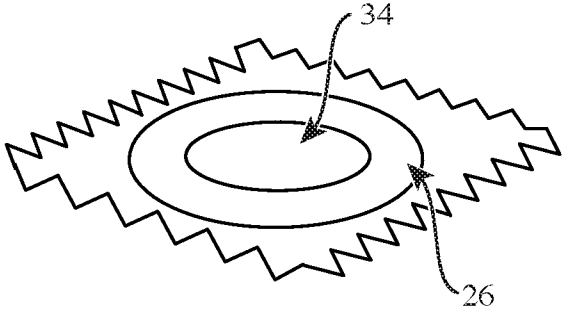
Figure 5:
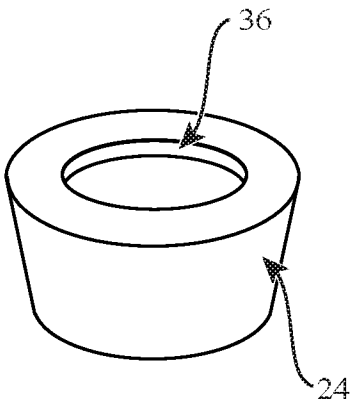
FIG. 5 is a perspective view of a foot for mounting to a platform of a mattress in accordance with an embodiment of the present invention.

Referring to FIGS. 1, 2, and 3, a mattress 10 may be understood with respect to a vertical direction 12*a*, horizontal direction 12*b*, and a longitudinal direction 12*c* that are all perpendicular to one another. Although a mattress 10 is disclosed below, the configuration of the mattress 10 may be used in other applications such as pillows, seat cushions, or in any other application where cushioning is needed.

The mattress 10 may include a foam layer 14 and a platform 16. The top and bottom of the foam layer 14 and platform 16 may be substantially planar (planar portion lies completely between two planes separated by less than 1 cm) along substantially all (at least 90%) of their upward and downward facing surfaces when resting on a flat surface parallel to the horizontal and longitudinal directions 12*b*, 12*c*. The foam layer 14 is stacked above the platform 16 along the vertical direction 12*a*. The platform 16 may be an inflatable bladder inflated by means of a valve 16*a*.

The foam layer 14 may be surrounded by a cover 18. The cover 18 is preferably air permeable and covers a foam, such as a memory foam, open-cell foam, or closed-cell foam. Multiple layers of foam may be used with differing densities and stiffnesses, as discussed below. The cover 18 may alternatively be airtight and may be provided with a valve. The valve may be a Halkey-Roberts valve, Boston valve, Schrader valve, Presta valve, or other valve known in the art. The valve may protrude from a top, bottom or side surface of the covering 18. This may be helpful in order to pump air into the cover in order to adjust the firmness of the foam layer and cover 18. This may also be helpful when rolling the foam layer 14: vacuum may be applied to the valve to pump air out of the covering 18, thereby making the foam layer 14 thinner and more easily compressed and rolled up.

In some embodiments, the cover 18 includes additional material forming a pocket 18*a* for holding personal items of the user.

In some embodiments, the foam layer 14 may be secured to the platform 16. For example, rails 20 may secure to the top surface of the platform 16 and have a portion 22 of a zipper formed on their distal edges, i.e. a row of zipper teeth. The rails 20 may be formed of folded material with the edge portions splayed out and adhered to the top surface of the platform 16. In the illustrated embodiment, the rails 20 extend substantially (e.g., within 5 degrees of) parallel to the longitudinal dimension 12*c* and are offset slightly, e.g. from one to three inches from the left side and right sides of the platform 16. Corresponding rails 20 and zipper portions 22 (not shown) may secure to the bottom of the cover 18 in the same manner. Slides for securing zipper portions 22 on the platform 16 to zipper portions 22 on the cover 18 may be mounted to the zipper portions 22 on either the platform 16 or cover 18.

In order to improve comfort and usability, the lower surface of the platform 16 may rest on feet 24 that further elevate the top of the foam layer 14. The feet 24 may further enable the mattress 10 to bridge irregularities (rocks, tree roots, etc.) in a surface on which the mattress 10 rests. In the illustrated embodiment, there are six feet, three distributed along the longitudinal direction 12*c* along the left edge and spaced slightly inward (e.g., from one to three inches) from the left edge. Another three are distributed along the longitudinal direction 12*c* along the right edge and spaced slightly inward (e.g., from one to three inches) from the left edge. The feet 24 at the ends of the platform 16 along the longitudinal direction 12*c* may also be spaced slightly inward from the ends of the platform 16. In some embodiments, the platform 16 is sufficiently stiff such that only four feet at each corner and spaced lightly inward therefrom are used. Alternatively, additional feet may be positioned more inboard of the sides of the platform 16. In combination, the feet 24, platform 16, and foam layer 14 may raise the top surface of the foam layer 14 to at least 8 inches, preferably at least 10 inches, and more preferably at least 12 inches off a support surface.

Referring specifically to FIG. 3, the foam layer 14 may include one or more layers 14*a*, 14*b*. In particular, the top layer 14*a* along the vertical direction 12*a* may be softer than the bottom layer 14*b*. In particular, the top layer 14*a* may be a polyurethane foam, such as memory foam. For example, a memory foam may be used for the top layer 14*a* whereas a firmer foam may be used for the bottom layer 14*b*. For example, the top layer 14*a* may have an indentation force deflection (IFD) of less than 30, preferably between 12 and 25, and more preferably between 12 and 16. according to the American Society of Testing and Materials (ASTM) D 3574 standard, which is hereby incorporated herein by reference in its entirety. In contrast, the bottom layer 14*a* may have an IDF according to the same standard that is greater than 25, preferably greater than 50. The layers 14*a*, 14*b* may be adhered to one another or held together by the cover 18.

FIG. 3 further illustrates the interior of that platform 16. The platform 16 may include a cover 26 with the top surface and the bottom surface being substantially parallel to one another when the cover 26 is inflated. The top surface and bottom surface of the cover 26 are secured to one another by threads 28 that maintain the top and bottom surface parallel to one another and cause a strain-locking effect when the cover 26 is inflated that provide stiffness that is much greater than the stiffness of the inflated cover 26 in the absence of the threads 28. The threads 28 may be put in place by a drop stitching process applied to an inner layer of the cover 26 followed by applying an outer layer or sealant to make the cover 26 airtight. Likewise, a sidewall may be adhered along the edges of the platform 16 to complete the cover 26 and make it airtight. The cover 26 of the platform 16 may be made of polyvinyl chloride (PVC) or other suitable polymer. The cover 26 may have a thickness of approximately 1.0 mm (e.g., from 0.8 to 1.2 mm). In some embodiments, a single layer of PVC is used. In others, two layers are used for increased durability at the expense of greater weight and stiffness when deflated.

The number of threads per square inch may be 20 or greater, preferably 100 or greater. The threads 28 may be substantially parallel to the vertical direction 12*a* when the cover 26 is inflated. In some embodiments, the cover is inflated to a pressure of from 6 to 20 psi in order to achieve a desired stiffness of the platform 16.

Referring to FIGS. 4A, 4B, 5, 6A, and 6B the feet 24 may secure to the platform 16 by various means. In the illustrated approach, cylindrical portions 32 protrude from the bottom surface of the cover 26 of the platform 16. The height of the cylindrical portion 32 about its axis of symmetry may be from 0.5 to 1.5 inches. The cylindrical portions 32 may be secured to, or formed monolithically formed with, planar portions 34 that provide greater area for adhesion to the cover 26 of the platform 16. The planar portions 34 may be secured by means of adhesives, welding, stitching and sealant, or other fastening means.

Figure 6A:
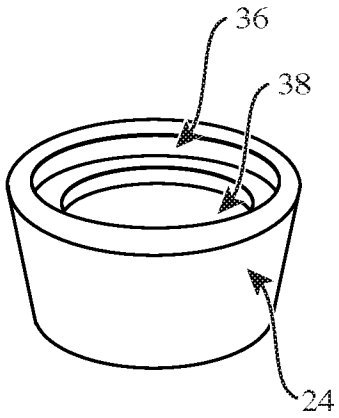
FIGS. 6A and 6B is a perspective view of an alternative embodiment of a foot in accordance with an embodiment of the present invention.
Figure 6B:
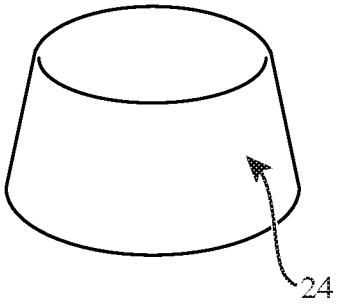

Each foot 24 may define a cylindrical recess 36 sized to receive one of the cylindrical portions. The recess 36 may be sized to receive the cylindrical portion 32 loosely such that the weight of the platform 16 and foam pad 14 keep it in place. The recess 36 may be sized to receive the cylindrical portion 32 with an interference fit such that deformation of the foot or cylindrical portion 32 is required for insertion. As shown in FIGS. 6A and 6B, the foot 24 may include an additional recess 38 such that the foot 24 is hollow in order to save weight. The foot 24 may have an outer surface that is circular and that is tapered with distance from the top surface when in use along its axis of symmetry. Alternatively, the outer surface may be generally cylindrical except for rounding at the top and bottom, texturing, and any labeling molded into the outer surface.

Figure 7:
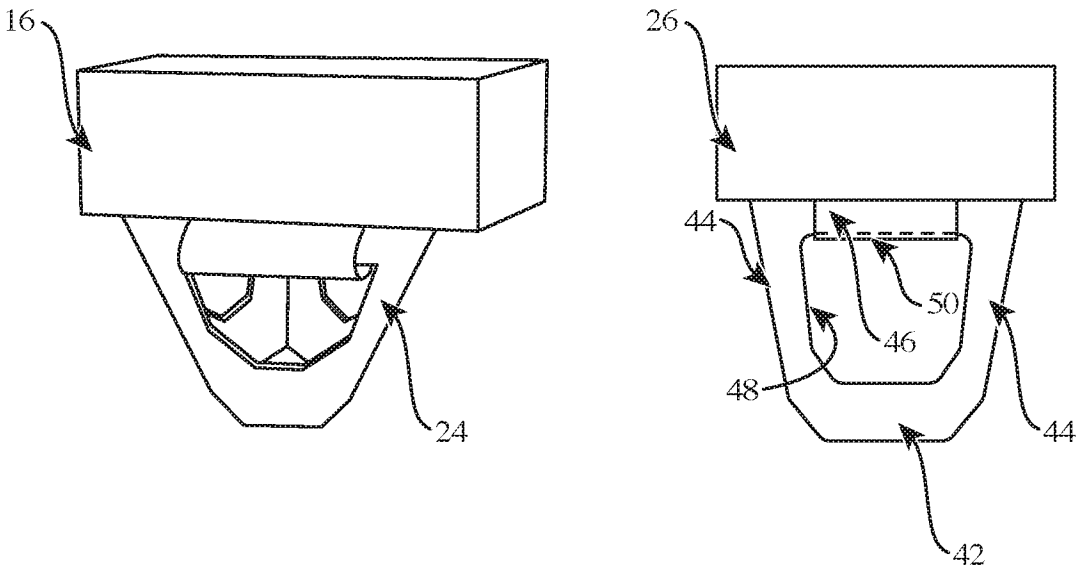
FIG. 7 is a perspective view of another alternative embodiment of a foot and mounting structure for a platform of a mattress in accordance with an embodiment of the present invention.

FIG. 7 illustrates an alternative approach for implementing a foot 24. In the illustrated embodiment, the foot 24 includes a base 42 for resting on a support surface and four or more legs 44 extending upwardly from the base. Cross pieces 46 extend between pairs of the legs 44, thereby defining openings 48. A flap 50 is secured at one end to the bottom surface of the cover 26 of platform 16. A free end of the flap 50 is passed through a pair of opposing openings 48 and secures to the bottom surface of the platform 16, such as by means of a first hook-and-loop fastening element secured to the flap 50 engaging a second hook-and-loop fastening element secured to the bottom surface of the platform 16.

Figure 8:
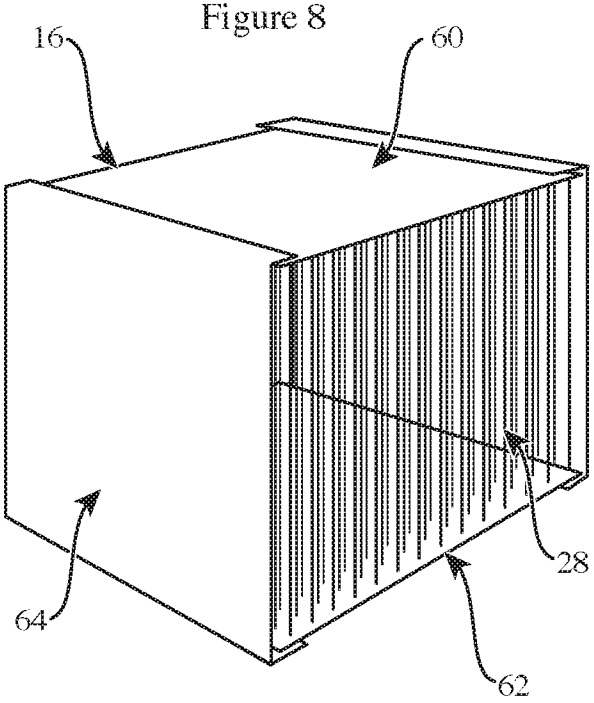
FIG. 8 is a cross-sectional view of a platform for a mattress showing drop stitches in accordance with an embodiment of the present invention.
Figure 9:
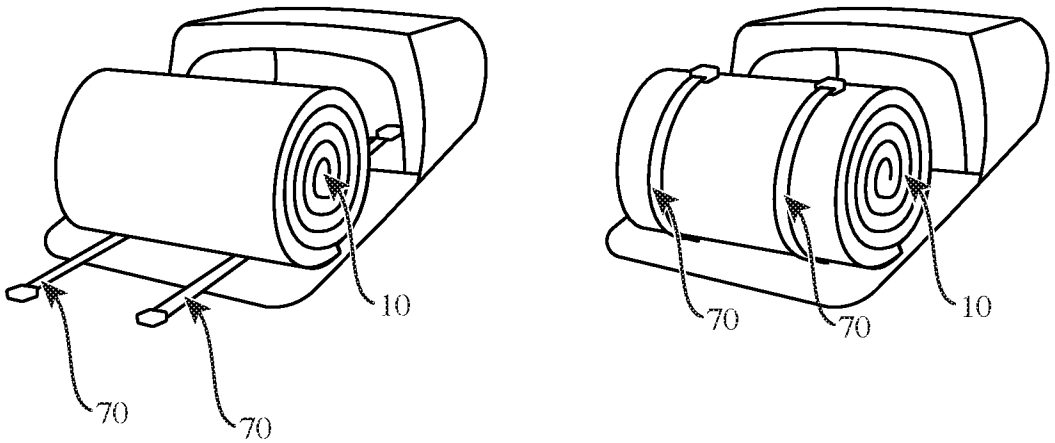
FIG. 9 is a perspective view of a rolled mattress in accordance with an embodiment of the present invention.
Figure 10:
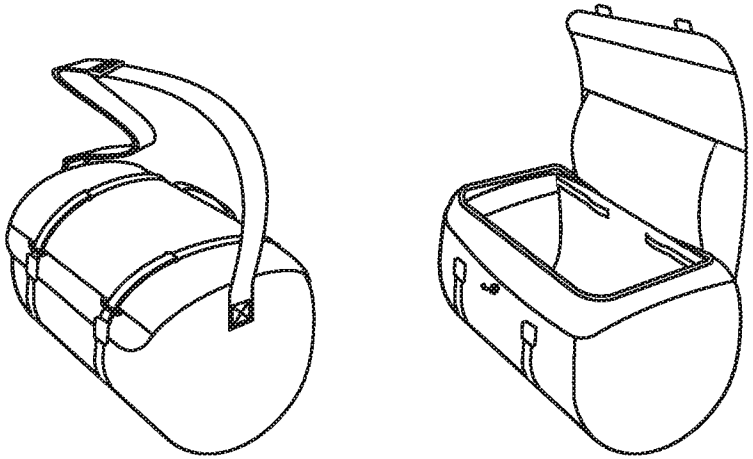
FIG. 10 is a perspective view of a bag for carrying the rolled mattress.
Figure 11:
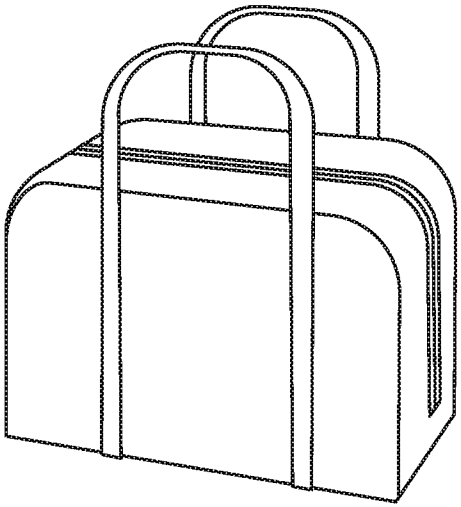
FIG. 11 is a perspective view of an alternative embodiment of a bag for carrying the rolled mattress.

FIG. 8 provides a detailed view of the structure of the platform 16. As is apparent, the platform 16 includes a top surface 60 and a bottom surface 62 having the threads 28 secured at either end to the top surface 60 and bottom surface 62. These threads may be placed according to the drop stitch approach known in the art and have a density, i.e. threads per square inch of the top and bottom surfaces 60, 62, sufficient to stiffen the platform 16. Following placement of the threads, the top surface 60 and bottom surface 62 may be further sealed by applying a sealant or adhering an additional layer onto the top surface 60 and bottom surface 62. As noted above, the top surface 60 and bottom surface 62 may be formed of one or more layers of PVC. Sidewall 64 may be secured around edges of the top surface 60 and bottom surface 62 in order to seal the interior of the platform 16. For example, edges of the sidewall 64 may be adhered to the top surface 60 and bottom surface 62 by means of adhesive, creating two seams around the top surface 60 and the bottom surface 62. The stop surface 60, bottom surface 62, and sidewall 64 therefore create an airtight inflatable bladder. The sidewall 64 may be formed of the same material as the top and bottom surface 60, 62 or a different material. A valve may be connected to the top surface, bottom surface 62, or sidewall 64 for filling the platform 16. The valve may be a Halkey-Roberts valve, Boston valve, Schrader valve, Presta valve, or other valve known in the art Referring to FIG. 9, the mattress 10 may be rolled up for storage and transport. In one method of use, the air is released from the platform 16 through a valve. In some embodiments, a vacuum pump may be used to evacuate air from the platform 16, thereby reducing its thickness and making it more easily rolled. The deflated platform 16 and foam layer 14 may be rolled up together. In some embodiments, an airtight cover 18 on the foam layer 14 enables the vacuum pump to also evacuate air from the cover 18, thereby compressing the foam layer 14 and enabling it to be more easily rolled. The rolled mattress 10 may be maintained in its rolled state by means of the illustrated straps 70. The rolled mattress 10 may be transported in the bags shown in either of FIGS. 10 and 11. The bags may include internal or external straps to secure the mattress 10 and prevent unrolling or such straps may be omitted. In some applications, the bag may be waterproof, such as for use when canoeing, rafting, kayaking or when traveling in wet environments. The bag may be sufficiently large to receive the rolled mattress 10 as well as the feet 24, a pump, and possibly other items such as pillows, bedding, headlamps, or other gear.

Figure 12:
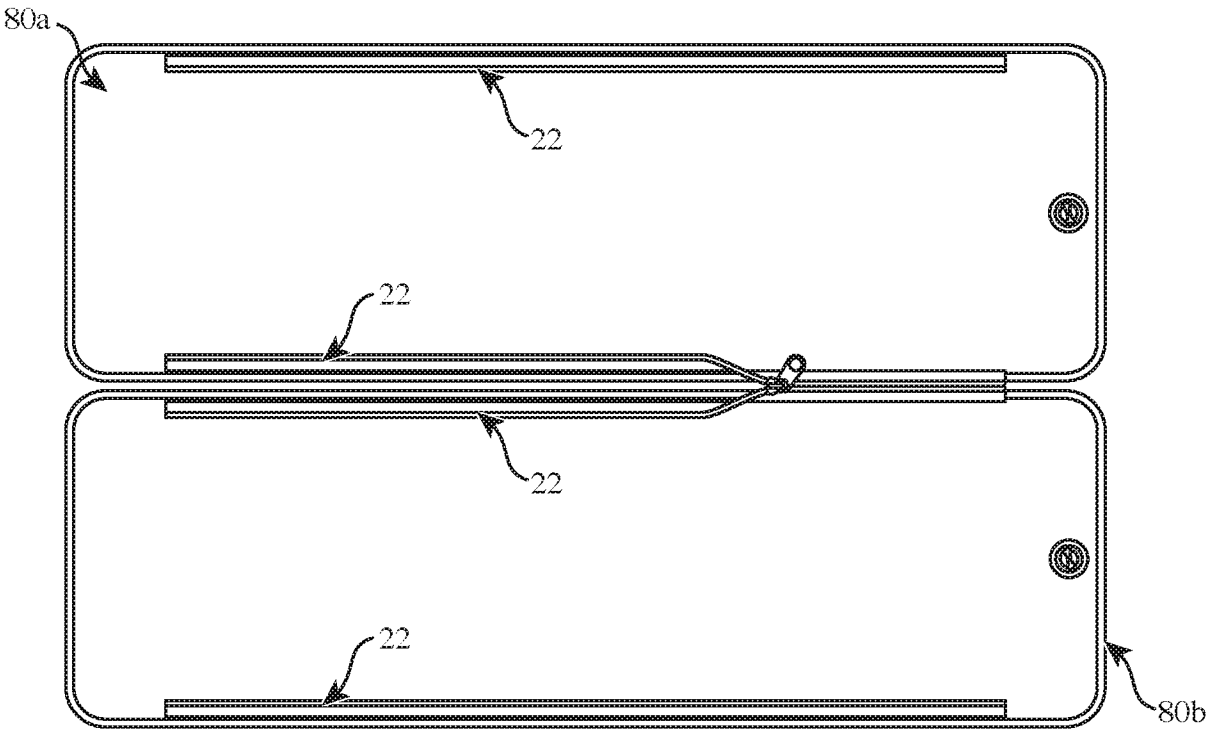
FIGS. 12 and 13 are top views of a mattress illustrating zipping of two mattresses to one another in accordance with an embodiment of the present invention.
Figure 13:
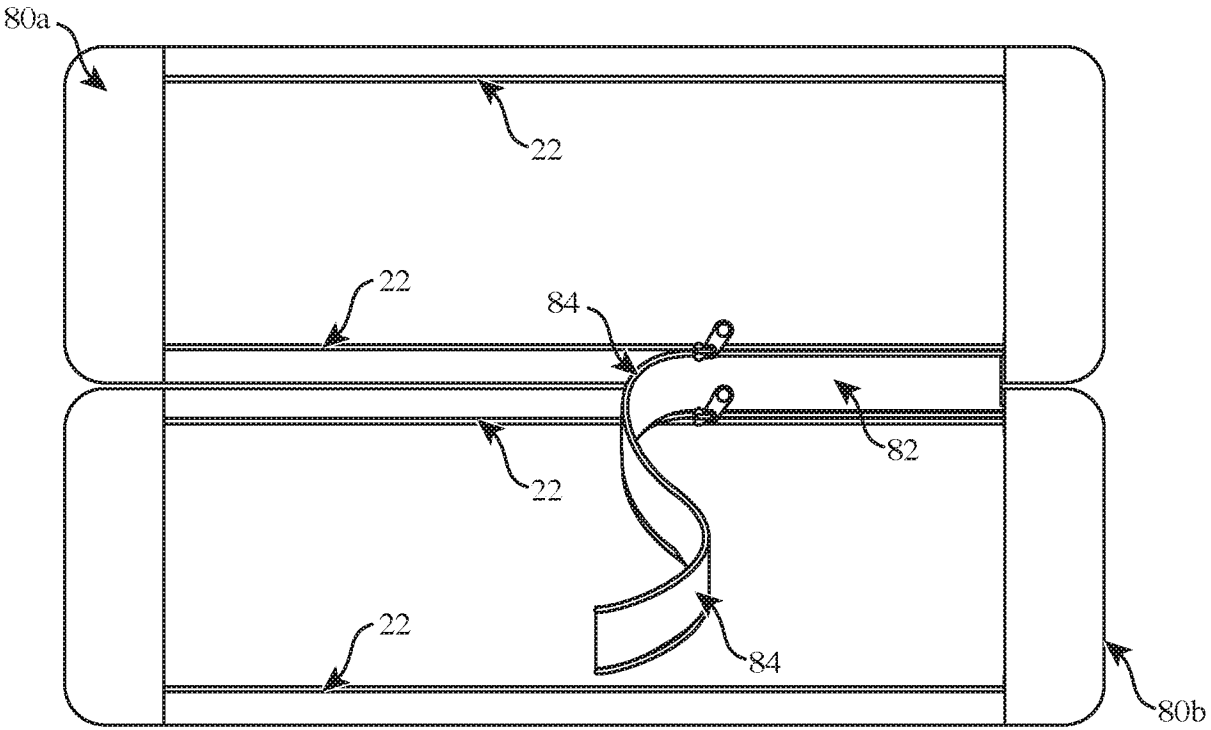

Referring to FIGS. 12 and 13, in some instances, multiple mattresses may be fastened together during use. For example, in the embodiment of FIG. 12, the zipper portion 22 of mattress portion 80*a* is fastened to the zipper portion 22 of the mattress portion 80*b*. The mattress portions 80*a*, 80*b* may either both be platforms 16 or foam layers 14.

The outboard zipper portions 22 of the mattress portions 80*a*, 80*b* remain available to secure to another portion of the mattress 10. In particular, the illustrated zipper portions 22 may be those formed on the platform 16 such that the outboard zippers 22 are available to secure to a pair of foam layers 14 positioned above the platforms. In another case, the illustrated zipper portions 22 may be those formed on the foam layers 14 such that the outboard zipper portions 22 are available to secure to the platform 16. Note that in some embodiments, either use case is possible depending on the choice of the user.

Referring specifically to FIG. 13, in some embodiments a bridge strip 82 is used to extend between the inboard zipper portions 22 of the mattress portions 80*a*, 80*b*. The bridge strip 82 includes zipper portions 84 along both edges that secure to the inboard zipper portions 2.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A cushion comprising:

a platform comprising:

a bladder having a top surface and a bottom surface, and a valve, the bladder comprising a first cover, and the bladder being airtight when the valve is closed, a first fastener portion being affixed to the top surface; and an array of threads each extending from the top surface to the bottom surface, the array of threads being distributed over an extent of the top surface and the bottom surface and being sufficient in number that the bladder and the array of threads, when inflated, are stiffer than the bladder alone without the array of threads when inflated; and a foam pad separate from the first cover and having a second fastener portion secured thereto and configured to engage the first fastener portion to detachably secure the foam pad to the platform over the top surface of the platform, the foam pad being at least two inches thick;

wherein the first fastener portion is secured to first and second rails secured to the top surface; and wherein the first and second rails are each formed of folded material having edge portions splayed out and adhered to the top surface.

2. The cushion of claim 1, wherein the foam pad comprises a polyurethane foam.

3. The cushion of claim 1, wherein the foam pad comprises a memory foam.

4. The cushion of claim 1, wherein the foam pad has an indentation force deflection (IFD) according to ASTM D 3574 of less than 30.

5. The cushion of claim 1, wherein the foam pad has an indentation force deflection (IFD) according to ASTM D 3574 of less than 50.

6. The cushion of claim 1, wherein the foam pad includes a first layer and a second layer, the second layer being positioned between the first layer and the platform, the second layer being firmer than the first layer.

7. The cushion of claim 1, wherein the threads are distributed over the top and bottom surface with a density of at least 20 threads per square inch.

8. The cushion of claim 1, wherein the top and bottom surfaces of the bladder are separated by a distance of at least four inches.

9. The cushion of claim 1, wherein the foam pad has a thickness of at least four inches, the foam pad further comprising a cover separate from the first cover.

10. The cushion of claim 1, wherein the top surface and the bottom surface are substantially planar when the bladder is inflated to at least 6 psi.

11. The cushion of claim 1, wherein the top surface and the bottom surface are each at least 60 inches long and 24 inches wide when the bladder is inflated to at least 6 psi.

12. The cushion of claim 1, wherein the top surface and the bottom surface are separated by a distance of at least three inches when the bladder is inflated above 6 pounds per square inch (psi).

13. The cushion of claim 1, wherein the bladder comprises polyvinyl chloride polymer.

14. The cushion of claim 1, further comprising a plurality of feet mounted to the bottom surface.

15. The cushion of claim 14, wherein the plurality of feet comprise at least six feet.

16. The cushion of claim 14, further comprising a plurality of disks adhered to the bottom surface, each foot of the plurality of feet defining a recess sized to receive a disk of the plurality of disks.

17. The cushion of claim 1, wherein the first fastener portion is a first zipper portion secured to the top surface of the bladder and the second fastener portion is a second zipper portion secured to the foam pad, the first zipper portion being selectively securable to the second zipper portion.

18. The cushion of claim 1, wherein the second cover is formed of an air permeable material.

19. The cushion of claim 1, wherein dimensions of the foam pad in a longitudinal direction and a horizontal direction corresponds to dimensions of the platform in said longitudinal direction and said horizontal direction respectively.

20. A cushion comprising:

a platform comprising:

a bladder having a top surface and a bottom surface, and a valve, the bladder comprising a first cover, and the bladder being airtight when the valve is closed, a first fastener portion being affixed to the top surface; and an array of threads each extending from the top surface to the bottom surface, the array of threads being distributed over an extent of the top surface and the bottom surface and being sufficient in number that the bladder and the array of threads, when inflated, are stiffer than the bladder alone without the array of threads when inflated; and a foam pad separate from the first cover and having a second fastener portion secured thereto and configured to engage the first fastener portion to detachably secure the foam pad to the platform over the top surface of the platform, the foam pad being at least two inches thick;

wherein the first fastener portion is a first zipper portion secured to the top surface of the bladder and the second fastener portion is a second zipper portion secured to the foam pad, the first zipper portion being selectively securable to the second zipper portion;

wherein the first zipper portion is secured to first and second rails secured to the top surface; and wherein the first and second rails are each formed of folded material having edge portions splayed out and adhered to the top surface.

* * * * *